US005690127A

United States Patent [19]

Chapman et al.

[11] Patent Number: 5,690,127

[45] Date of Patent: Nov. 25, 1997

[54] HOLLOW CIGARETTE

[75] Inventors: John J. Chapman; David R. Smart, Jr., both of Greensboro, N.C.

[73] Assignee: Lorillard Tobacco Company, New York, N.Y.

[21] Appl. No.: 630,550

[22] Filed: Apr. 10, 1996

Related U.S. Application Data

[63] Continuation-in-part of Ser. No. 281,909, Jul. 28, 1994, abandoned.

[51] Int. Cl.[6] ..... A24B 15/28

[52] U.S. Cl. ..... 131/364; 131/361; 131/360

[58] Field of Search ..... 131/194, 355, 131/359, 364, 360, 365, 361

[56] References Cited

U.S. PATENT DOCUMENTS

| | | | |
|---|---|---|---|
| 3,404,691 | 10/1968 | Moshy et al. | 131/355 |
| 4,142,534 | 3/1979 | Brantl | 131/364 |
| 4,219,031 | 8/1980 | Rainer et al. | 131/364 |
| 4,256,123 | 3/1981 | Lendvay et al. | 131/428 |
| 4,286,604 | 9/1981 | Ehretsmann et al. | 131/364 |
| 4,391,285 | 7/1983 | Burnett et al. | 131/364 |
| 4,481,958 | 11/1984 | Rainer et al. | 131/364 |
| 4,893,639 | 1/1990 | White | 131/364 |
| 4,917,121 | 9/1990 | Riehl et al. | 131/364 |
| 5,027,836 | 7/1991 | Shannon et al. | 131/364 |
| 5,033,483 | 7/1991 | Clearman et al. | 131/364 |
| 5,092,306 | 3/1992 | Bokelman et al. | 13/364 |

FOREIGN PATENT DOCUMENTS

| | | | |
|---|---|---|---|
| 1185887 | 3/1970 | United Kingdom | 131/194 |

*Primary Examiner*—Vincent Millin
*Assistant Examiner*—Charles Anderson
*Attorney, Agent, or Firm*—White & Case

[57] ABSTRACT

A cigarette comprises a hollow rod for directing smoke and air from the lit end of the cigarette to a filter located at the mouth end of the cigarette. The rod is formed of tobacco material and/or other carbonaceous material, together with a binder and preferably an organic or inorganic salt. In one embodiment, the rod is a low density rod, which when lit burns in an inverted fire cone. In a second embodiment, a thin-walled rod is surrounded by a column of leaf tobacco. The thin-walled rod includes a salt, preferably calcium carbonate, in an amount preferably between 25% and 45%, which increases the combustion temperature. It also preferably is perforated to allow smoke generated in the tobacco column to be drawn into the hollow center passage. In either embodiment, the amount of wet particulate matter is reduced due to the improved combustion characteristics.

17 Claims, 5 Drawing Sheets

HOLLOW CIGARETTE

CROSS-REFERENCE TO RELATED APPLICATIONS

The present application is a continuation-in-part of U.S. patent application Ser. No. 08/281,909, filed Jul. 28, 1994 now abandoned.

FIELD OF THE INVENTION

The present invention relates to cigarettes having novel combustion characteristics.

BACKGROUND OF THE INVENTION

Conventional cigarettes, such as that depicted in FIG. 1, comprise a cylindrical tobacco rod 10 that is between 7.0 and 10.0 mm in diameter and 60 mm and 125 mm in length. The tobacco rod, which is composed of one or more selected types of cut tobacco, is wrapped in cigarette paper 12 along its outer circumference. A filter 14, preferably of modified cellulose acetate or some other cellulosic material, is attached, in end-to-end relation, to the mouth end of the tobacco rod by a filter wrap 16. During puffs, smoke from the lit end 18 of the cigarette travels the length of the tobacco rod 10 and filter 14 to the smoker.

In a conventional cigarette, the outer circumferential region of the tobacco, i.e., the region adjacent to the paper 12, burns ahead of the interior region of the tobacco rod. As a result, the lit end 18 is essentially convex in shape, as shown in FIG. 1. Between puffs, smoke 19 is emitted from the lit end 18. The smoke emitted between puffs is generally referred to as "sidestream smoke".

In the past, there have been many proposals relating to smokable articles that can be used as alternatives to traditional cigarettes. Some burn tobacco, as in conventional cigarettes. Others employ a different approach, in which they heat tobacco or other carbonaceous material, and capture the resulting volatiles in an air stream. For example, a number of proposals have used an aerosol generator, together with a separate fuel element, to produce a flavored aerosol which resembles tobacco smoke.

An example of the latter approach is disclosed in U.S. Pat. No. 5,027,836. In the '836 patent, a short carbonaceous fuel element is disposed in the forward end of the article, in contact with an aerosol generator, which is in the form of a carbon mass impregnated with propylene glycol and glycerine. When the fuel element is ignited and air is drawn over the element, the heat of the fuel element causes aerosols to be released into the airstream for inhalation by the smoker.

U.S. Pat. No. 5,033,483 discloses another example of a smokable article in which an aerosol is generated using a short carbonaceous fuel element and a separate aerosol generating element. In addition, however, tobacco may be burned to produce sidestream smoke.

U.S. Pat. No. 4,219,031 proposes placing a porous carbon fuel element in the center of the tobacco rod.

Another approach to modifying the conventional cigarette has been to replace the cut leaf tobacco with alternate materials. For example, U.S. Pat. No. 4,286,604 discloses replacing the tobacco with pyrolized viscose fibers. Processes have also been proposed for making cigarettes with reconstituted tobacco. For example, U.S. Pat. No. 4,256,123 proposes making a smokable material containing tobacco by-products, such as stems or stalks. In the '123 patent, tobacco by-products are cast in a slurry, which is then dried and cut up into strips similar to ordinary smoking tobacco.

Yet another proposal for modifying a cigarette involves providing a pre-filter, prepared from pyrolized material, downstream from the tobacco column, as disclosed in U.S. Pat. No. 4,481,958. As the tobacco column burns, and smoke is drawn through the pre-filter (and thereafter either through a conventional filter or through a second tobacco column), particulate matter is trapped in the pre-filter. When the lit end reaches the pre-filter, the smoker may smoke the pre-filter or, if the smoker does not wish to smoke the particulate matter-laden pre-filter, simply put the cigarette out.

U.S. Pat. No. 4,142,534 discloses using a glass rod to press a hollow opening into the center of the tobacco column of a conventional filter cigarette. A piece of rolled cigarette paper, that is closed off at the end closest to the filter, is inserted into the opening. As a result, during a normal puff, air is not pulled down the center opening, but rather travels through the thin outer column of the cut tobacco as in a normal cigarette. The applicants have prepared and tested cigarettes made according to the '534 patent, and determined that such cigarettes burn like a conventional cigarette, in which the outer periphery burns first with a normal convex fire cone, as described in connection with FIG. 1.

U.S. Pat. No. 4,893,639 discloses a process for increasing the density of carbon and/or tobacco material, to be used as a tobacco substitute. The compacted material acts as a substrate for an aerosol-forming substance. In one embodiment, a carbonaceous fuel element is located upstream of a metal jacket, containing the compacted substrate, which is surrounded by a column of tobacco. When puffed, heat from the fuel element releases the volatile components contained inside the substrate to form an artificial smoke stream. In another embodiment, the cut tobacco column of a conventional cigarette is replaced with a column of the compacted substrate.

U.S. Pat. No. 4,391,285 discloses a cigarette composed of a hollow rod made of a high density (e.g., greater than 1.0 g/cc), relatively low porosity, extruded tobacco material, without binders. The specific object of the patent is to make the material sufficiently dense and non porous as to prevent smoke from traveling through the material, in order to reduce the formation of tar. As a result, air travels over the lit end as it is drawn into the hollow passage, but does not travel through the lit end or into the unburned material lying below.

Proposals have also been made to attempt to reduce the amount of sidestream smoke produced by cigarettes. Prior proposals, such as disclosed in U.S. Pat. No. 5,092,306, have centered around modifying the cigarette paper.

SUMMARY OF THE INVENTION

The present invention is a cigarette whose smoking mechanism comprises a rod having an air passage extending longitudinally through its center for directing smoke and air from the lit end of the cigarette to a filter located at the mouth end of the cigarette. The hollow rod is composed of tobacco material or other cellulosic or pyrolized bone material, or combinations of such materials, which may, but do not need to be, pyrolized. The materials are mixed with one or more binders and, optionally, other ingredients, and then extruded, cast, or molded into a rod having an opening longitudinally through the center.

In one embodiment of the invention, the hollow rod has an external diameter in the range of 5–10 mm, an inside diameter between 0.5 and 6.5 mm, and a length between 20 and 125 mm. In this embodiment, it is critical that the hollow rod have a relatively low density, preferably less than 0.6 g/cc, and most preferably between 0.20 g/cc and 0.60 g/cc, so as to have sufficient porosity to allow substantial air flow through the lit end as air is drawn into the hollow passage. Preferably, the hollow rod is wrapped with cigarette paper, and preferably a filter is secured to the hollow rod, in an end-to-end relation, by a filter wrap, to form the cigarette.

As it burns, the lit end of a cigarette according to the first embodiment assumes the shape of an inverted, i.e., concave, fire cone, which burning mechanism is the opposite of a conventional cigarette, where the lit end assumes a convex shape as it burns. Due to the presence of more air pockets (and thereby lower density), a more efficient combustion, and less smoldering, results, which reduces the amount of wet particulate matter produced. Also, because the cigarette burns in an inverted fire cone, the amount of sidestream smoke is reduced.

The low density hollow rod is preferably formed of one or more of the following carbonaceous materials: tobacco (which may be pyrolized or non-pyrolized, and which may be puffed or non-puffed), partially or completely pyrolized tobacco dust, tobacco stems, reclaimed tobacco, pyrolized animal bones, coconut hulls, hardwood, or softwood. In the most preferred embodiment, the low density hollow rod is formed primarily of tobacco having particle sizes in the range of 0.20 mm to 0.70 mm.

In order to form the low density hollow rod, the pyrolized or non-pyrolized tobacco or other carbonaceous material or materials are mixed, together with one or more binders, in an aqueous, non-aqueous, or mixed aqueous/non-aqueous medium. Other materials, such as a salt, flavorants, sugars, or yeast, may be included in the matrix as well. The materials are dispersed well in the medium to obtain a damp, granular consistency, which is then extruded, cast, or molded into a low density hollow rod of predetermined size and shape.

Although the low density rod may be formed from a number of carbonaceous materials, a particularly preferred embodiment employs puffed tobacco. When a wet, granular matrix, in which puffed tobacco is the carbonaceous material, is extruded, upon drying the rod tends to expand, thereby resulting in a desirable increase in the porosity of the rod.

When the low density cigarette is lit, and a smoker takes a puff, air is drawn through the lit end of the hollow rod and into the central passage, and smoke and air in the central passage are drawn down longitudinally toward the filter. The inner longitudinal open passage through the center of the rod burns ahead of the outer periphery of the cigarette, and the lit end takes the shape of an inverted fire cone. Also, the low density of the cigarette and the air pockets contained within the wall structure reduces smoldering and produces a more complete combustion resulting in lower levels of wet particulate matter in the mainstream aerosol. An additional benefit is a reduction in the amount of sidestream smoke between puffs.

In an alternative embodiment of the invention, a thin wall hollow rod is surrounded by an annular column of leaf tobacco and wrapped in cigarette paper. In this embodiment, the hollow red preferably has an outside diameter between 1.0 and 5.0 mm, and an inside diameter between 0.5 and 3.0 mm. Preferably, a filter is secured in end-to-end relation to the hollow red and tobacco column and secured by a filter wrap to form the cigarette. The thin wall hollow red preferably is formed in a manner to have a higher density than in the low density hollow rod employed in the first embodiment, in order to have a higher strength-per-unit-weight. Preferably, however, the density is less than 1.0 g/cc.

The thin wall hollow rod is formed of a composition similar to the low density rod, but that will produce a higher burn temperature, such that the temperature of the lit end is substantially greater than that of a conventional cigarette. One of the ways of accomplishing this is to use higher levels of salt, e.g., calcium carbonate in a range of 5% to 55%, and preferably 25% to 45%, by weight. Another way is selecting carbonaceous materials, such as hardwoods, with a higher burn temperature. The higher temperature results in a more complete combustion of the surrounding tobacco column, with a corresponding reduction in the level of wet particulate matter generated.

Because it is less porous than the low density rod, most preferably the thin-walled hollow rod is perforated, e.g., by forming an array of perforations through the wall, so that during puffs smoke generated in the surrounding annular tobacco column is drawn into the hollow passage. In this manner, smoke originating from the annular tobacco column is re-burned as it is drawn through the glowing holes of the thin-walled rod into the hollow passage, and therefore pyrolized to a higher level than in a conventional cigarette, thereby reducing the level of wet particulate matter. By regulating the number and size of the holes, and thereby the porosity of the thin-walled rod, the proportion of the tobacco smoke that is drawn into the hollow passage, as compared to the amount of such smoke that is drawn through the tobacco column to the filter, can be varied to control the taste.

The process of forming the thin-walled hollow rod is also similar to that of the low density hollow rod, except that the process is chosen to produce a higher density, preferably between 0.7 and 0.9 g/cc. This can be accomplished, as described in greater detail below, by using smaller particle sizes in the matrix and/or by providing a higher moisture content so as to form a paste or dough-like consistency from which the cigarettes are extruded, cast, or molded. In addition, the thin-walled hollow rod embodiment uses a higher ratio of salt, e.g., calcium carbonate, and/or uses higher burning temperature materials (such as pyrolized hardwoods) in place of tobacco as the carbonaceous material in order to increase the combustion temperature of the thin-walled rod.

When the thin-walled embodiment is lit, and a smoker takes a puff, air is drawn through the lit end of the tobacco, toward the filter. Air is also drawn into the open end of the passage, passing over the lit end of the thin-walled rod and causing the material to burn at a relatively high temperature. As a result of the relatively high burn temperature of the rod, a more complete combustion of the tobacco occurs.

Due to the higher density of the thin-walled rod, less air passes through the lit end than in the case of the low density hollow rod, and the lit end will not have an inverted fire cone configuration. However, it has been found that, rather than assuming the convex shape of a conventional cigarette lit end, the lit end of the annular tobacco column and thin-walled hollow rod will remain essentially flat.

In the case where the thin-walled rod is provided with holes, the portion of the tobacco smoke which is drawn through the holes in the lit end is re-burned at the higher temperature, producing a further improvement in combustion.

As noted above, in the thin-walled rod, and preferably in the low density rod as well, an inorganic or organic salt is used in the formulation, along with the carbonaceous material and binder. The presence of the salt in the hollow rod enhances ash formation by releasing gases at elevated temperatures to fracture the inner wall structure of the hollow rods as they burn. The salt, when present in levels above 5%, also increases the combustion temperature in the final product, and for such reason is particularly desirable in the case of the embodiment comprising a thin-walled hollow rod surrounded by an annular tobacco column, to help induce a more complete combustion of the tobacco smoke.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 2:
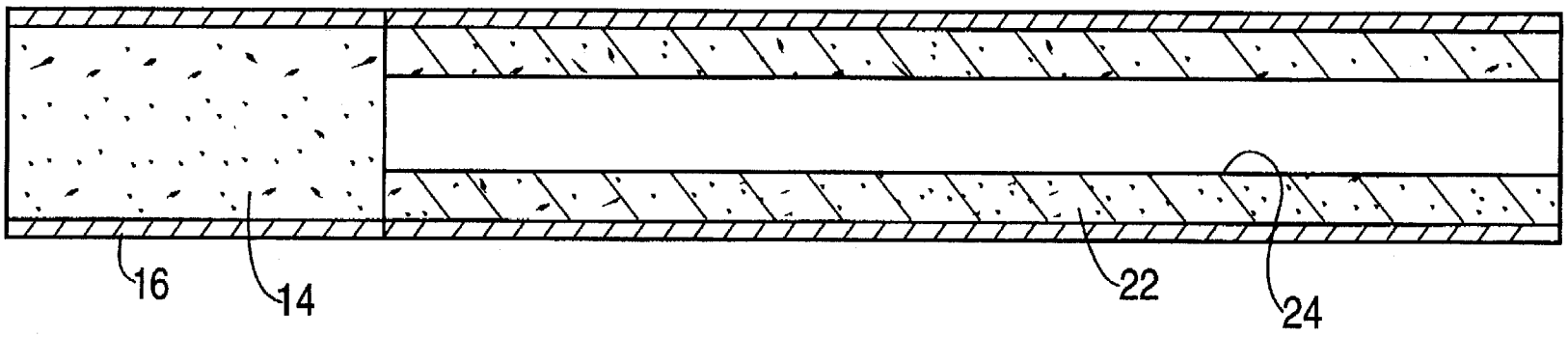
FIG. 2 is a side, sectional view of a cigarette according to a first preferred embodiment, in an unlit condition.

FIG. 2 shows a first embodiment of a cigarette 20. The cigarette 20 includes a hollow rod 22 defining an interior open passage 24 which extends from the outer end of the cigarette to the filter 14. The outer cylindrical surface of the hollow rod 22 is wrapped by cigarette paper 12. Preferably, the hollow rod 22 is between 5 and 10 mm in diameter, and most preferably about 8 mm in diameter. The open passage 24 is preferably between 0.5 mm and 6.5 mm in diameter, and most preferably 1.0–3.0 mm in diameter.

The hollow rod 22 is formed of one or more carbonaceous materials, which may include tobacco, hardwood, softwood, pyrolized bones, coconut hulls, tobacco stems of any variety, tobacco dust of any variety, or other tobacco material, together with a binder and various optional ingredients such as sugar and/or yeast, as described further below. The carbonaceous material may be either pyrolized or non-pyrolized. When tobacco is used as the carbonaceous material, it is preferably puffed, however, unpuffed tobacco may be employed. Examples of suitable hardwoods include hickory, maple, oak, beech, walnut, poplar, or locust. The softwood may be pine, cedar, or any of many other varieties, or a blend of these woods. The tobacco, stems, or dust may be flue cured, burley, or oriental tobacco, or a number of other varieties.

Examples of preferred carbonaceous materials and combinations of carbonaceous materials used to form the hollow rod 22 are as follows:

- pyrolized, partially pyrolized, or non-pyrolized tobacco
- pyrolized, partially pyrolized, or non-pyrolized tobacco dust
- pyrolized tobacco dust and pyrolized hardwood
- partially pyrolized tobacco dust and partially pyrolized hardwood
- non-pyrolized tobacco dust and non-pyrolized hardwood
- pyrolized tobacco dust and pyrolized softwood
- partially pyrolized tobacco dust and partially pyrolized softwood
- non-pyrolized tobacco dust and non-pyrolized softwood
- pyrolized tobacco dust and pyrolized animal bones
- partially pyrolized tobacco dust and partially pyrolized animal bones
- pyrolized, partially pyrolized, or non-pyrolized tobacco stems
- pyrolized tobacco stems and pyrolized hardwood
- partially pyrolized tobacco stems and partially pyrolized hardwood
- non-pyrolized tobacco stems non-pyrolized hardwood
- pyrolized tobacco stems and pyrolized softwood
- partially pyrolized tobacco stems and partially pyrolized softwood
- non-pyrolized tobacco stems and non-pyrolized softwood
- pyrolized tobacco stems and pyrolized animal bone
- partially pyrolized tobacco stems and partially pyrolized animal bone
- pyrolized, partially pyrolized, or non-pyrolized hardwood
- pyrolized, partially pyrolized, or non-pyrolized softwood The binder is preferably hydroxypropylcellulose, hydroxymethylcellulose, hydroxyethylcellulose, methylcellulose, ethylcellulose, carboxymethylcellulose, sodium carboxymethylcellulose, guar gum or other natural polymers known in the art. An inorganic or organic salt, preferably calcium carbonate, calcium formate, calcium citrate, or calcium propionate, or the corresponding sodium or potassium salts, is also preferably used.

To form the hollow rod 22, a mixture containing the carbonaceous material, e.g., puffed tobacco between 50–93% by weight, one or more binders in an amount between 0.05 and 3.0% by weight, and preferably salts between 0% and 55% by weight, but most preferably between 0.25% and 8.0% by weight, and optionally other ingredients such as flavorings, sugars, and/or yeast, is formed. The mixing is carried out at room temperature or above, but preferably at room temperature. This mixture is combined with an aqueous medium (e.g., water) or non-aqueous solution, or a mixed aqueous/non-aqueous medium (e.g., water/ethanol, water/propylene glycol, water/ethylene glycol, or ethanol/propylene glycol), to form a matrix having a wet, granular consistency, which is then extruded, molded, or cast to form the hollow rod 22. The rod 22, after drying, is relatively hard, with enough flexibility for processing, and a smooth-to-slightly granular surface finish.

Prior to forming the hollow rod 22, some or all of the carbonaceous materials may be pyrolized, although preferably the majority of the carbonacesous materials are non-pyrolized. In an example of a pyrolysis process, the carbonaceous materials are heated in a vacuum or in a nitrogen or other inert atmosphere at a temperature in the range of 90° C. to 1000° C., and most preferably between 200° C. and 800° C. for a period of 1 to 5 hours.

The materials are preferably pyrolized so that the final product is between 5% and 90% of its initial weight. The tobacco products may be pyrolized at lower temperatures if a lower weight reduction is desired, and at a higher temperature if a greater weight reduction is desired. Temperatures closer to 90° C. are used to achieve weight reductions in the range of 5%, whereas temperatures closer to 1000° C. are used where it is desired to achieve weight reductions more than 90%.

The ingredients and process used to form the hollow rod 22 are selected so as to form a low density final product. For purposes of this application, a "low density" rod means densities less than 0.6 g/cc, and preferably in the range of 0.20–0.60 g/cc. Examples are give hereafter of suitable combinations and processes, but in general producing a rod with the desired low density can be achieved in various ways such as by controlling moisture content, such that the pre-extruded mixture is a moist, granular configuration, or by using puffed tobacco as the basic carbonaceous material, using relatively larger particle sizes for the tobacco ingredient, or by using a filler (e.g., salt) that decomposes after extrusion to leave more pore space. The use of puffed tobacco is particularly desirable, because we have found that, after extrusion, the rod expands when it is dried, thereby increasing porosity.

Figure 1:
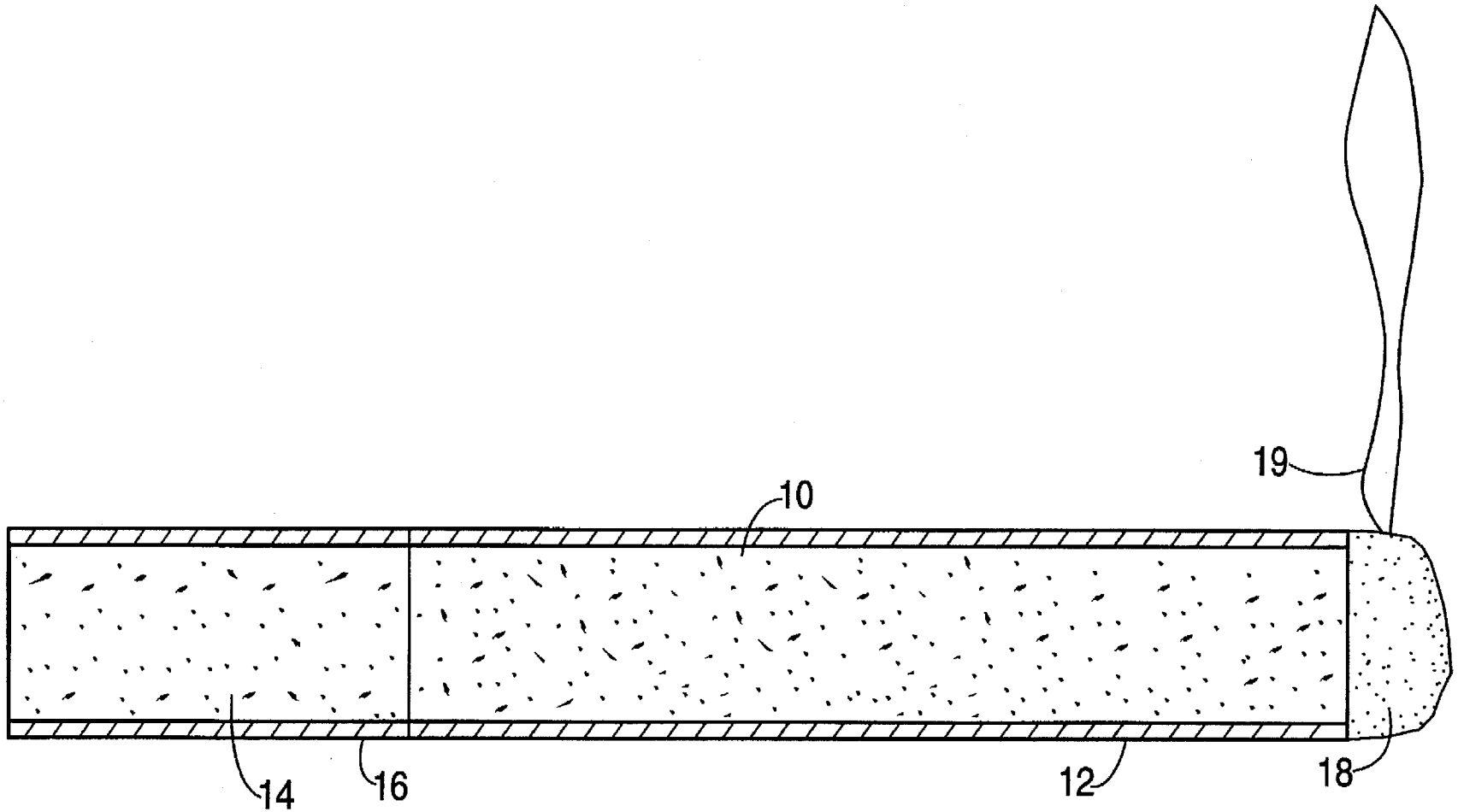
FIG. 1 is a side, sectional view of a conventional cigarette in a lit condition.
Figure 3:
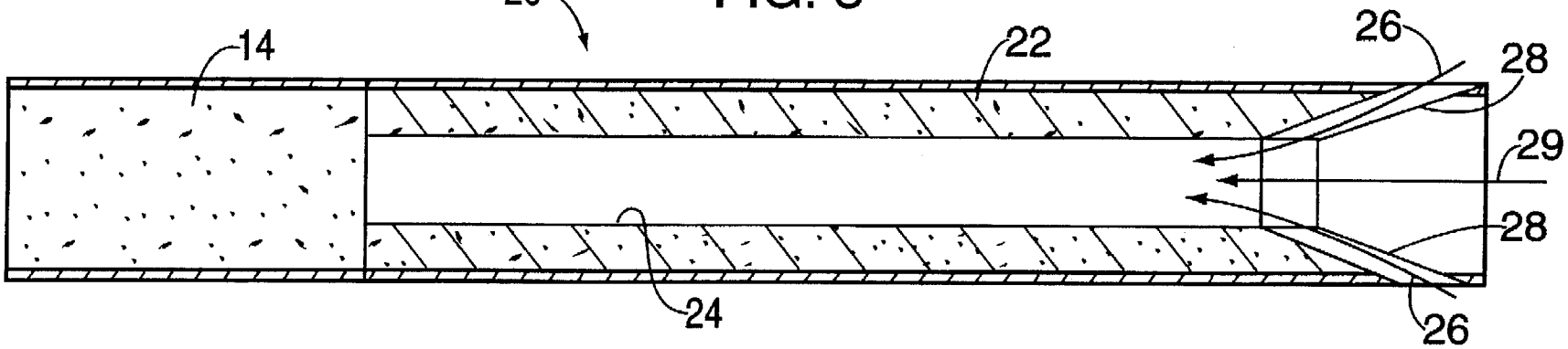
FIG. 3 is a side, sectional view of a cigarette of FIG. 2, shown in a lit condition.

As shown by the arrows 26 in FIG. 3, when the cigarette 20 is lit, during puffs, air is drawn through the lit end 28 of the cigarette 20. The resulting smoke is drawn into the passage 24, to combine with outside air 29 entering through the open end of the passage 24, which then travels toward and through the filter 14. Due to the novel aerodynamics of the system, the cigarette 20 burns as an inverted fire cone, i.e., the inside rim of the hollow rod, surrounding the open passage 24, burns ahead of the outer periphery of the rod 22. This is in contrast to conventional cigarettes where, as shown in FIG. 1, the outer periphery tends to burn first, while the interior of the tobacco rod smolders, creating a convex fire cone. Moreover, due to the high oxygen content in the inverted concave fire cone 28 of the present invention, the mainstream smoke is heat treated and achieves a greater degree of combustion. The result is a reduction in particulate matter. An additional benefit is a reduction in the level of sidestream smoke between puffs.

Figure 4:
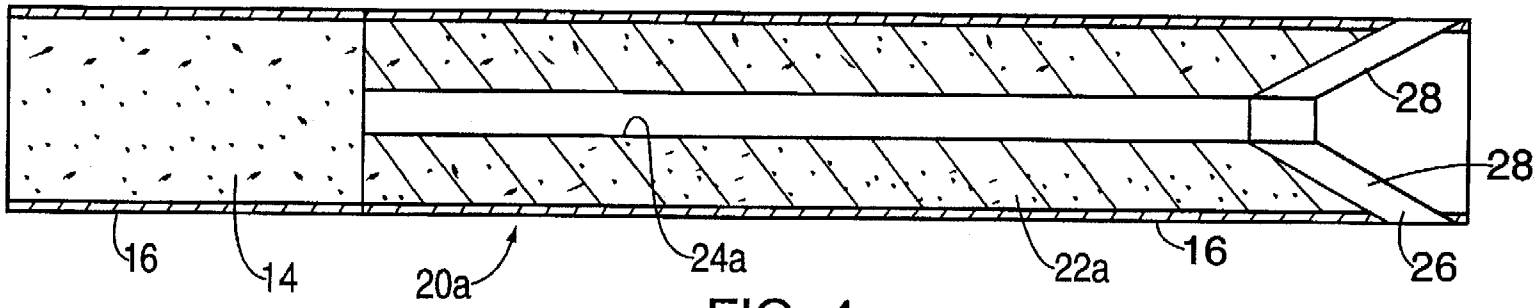
FIG. 4 is a side, sectional view of another embodiment of a cigarette, shown in a lit condition.

FIG. 4 shows an alternative embodiment of a cigarette 20*a*, in which the hollow rod 22*a* is thicker than in FIG. 2, resulting in a smaller passage 24*a*. The embodiment of FIG. 4 is formed in the same manner as FIG. 2, except that the rod's hollow interior is extruded, molded, or cast with a smaller inside diameter, and burns with a similar inverted fire cone combustion mechanism.

Figure 5:
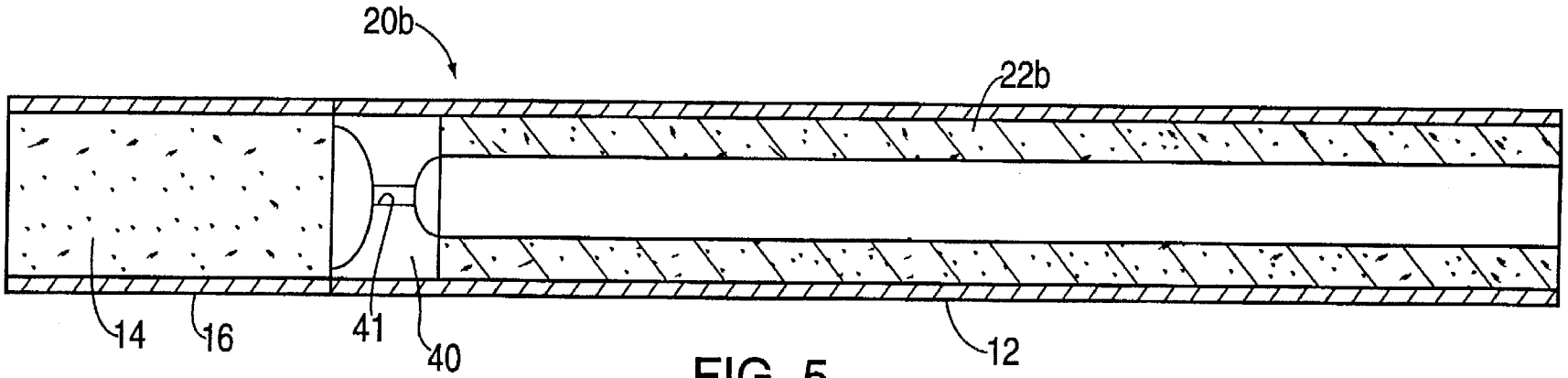
FIG. 5 is a side, sectional view of a third embodiment of a cigarette, shown in an unlit condition.

FIG. 5 shows another variation on FIG. 2, in which a carbon disk 40, which includes a central opening 41 through which smoke and air can pass, is interposed between the low density rod 22*b* and the filter 14. The diameter of the opening is preferably 0.742 mm. The low density rod 22*b* may have the same composition and dimensions as rod 22 or rod 22*a*, except that, due to the presence of disk 40, it will be shorter in length, for the same overall length cigarette, as FIG. 2 or FIG. 3. The cigarette 20*b* burns in the same manner as cigarettes 20 and 20*a*, except that the carbon disk 40 serves as a heat shield between the lit end and the filter 14.

Figure 6:
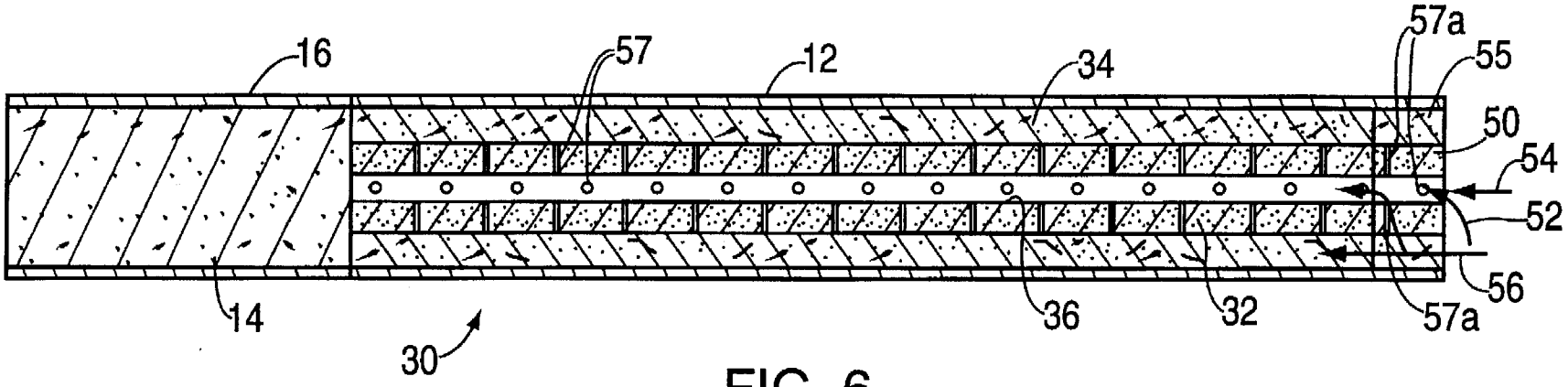
FIG. 6 is a side, sectional view of a cigarette according to a fourth embodiment of the invention, shown in a lit condition.

FIG. 6 shows an embodiment of a cigarette 30 containing a thin-walled hollow rod 32. The rod 32 is encased in the center of an annular column of cut tobacco 34, which in turn is wrapped in cigarette paper 12. The hollow rod 32 includes an open passage 36 extending longitudinally through the total length of the rod. A filter wrap 16 surrounds and secures a filter plug 14 to one end of the hollow rod.

In the embodiment of FIG. 6, the open passage 36 of the hollow rod 32 preferably has an inner diameter between 0.5 and 3 mm, and the rod 32 has an external diameter between 1.0 and 5.0 mm and a length between 20 and 125 mm. The cigarette 30, including the annular column of cut tobacco 34 and cigarette paper 12, preferably has an outer diameter between 5.0 and 10.0 mm, and most preferably 8 mm as in conventional cigarettes. The embodiment of FIG. 6 may also employ a carbon disk 40, as used in FIG. 5.

Because rod 32 has less wall thickness than the rods 22, 22*a*, or 22*b*, it is desirable to give the rod 32 a higher density, for greater strength. Preferably, the rod 32 has a density of slightly less than 0.9 g/cc. For purposes of this application, we will refer to rods having a density between 0.6 g/cc and 1.0 g/cc as "medium density rods". Discussed above are general ways to produce what, for purposes of this application, we have termed a "low density" rod. In the thin walled rod of FIG. 6, the preferred medium density can be achieved by not employing such techniques. For example, preferably puffed tobacco is not used. Also, preferably the tobacco is ground up into a smaller particle size to produce a more compacted product, and/or a higher moisture content is used to achieve a more dough-like consistency.

The principal difference in the compositions between FIGS. 2–5 and FIG. 6, other than those designed to produce a denser rod, are that the FIG. 6 embodiment preferably includes a higher level of salt, e.g., calcium carbonate.

Figure 7:
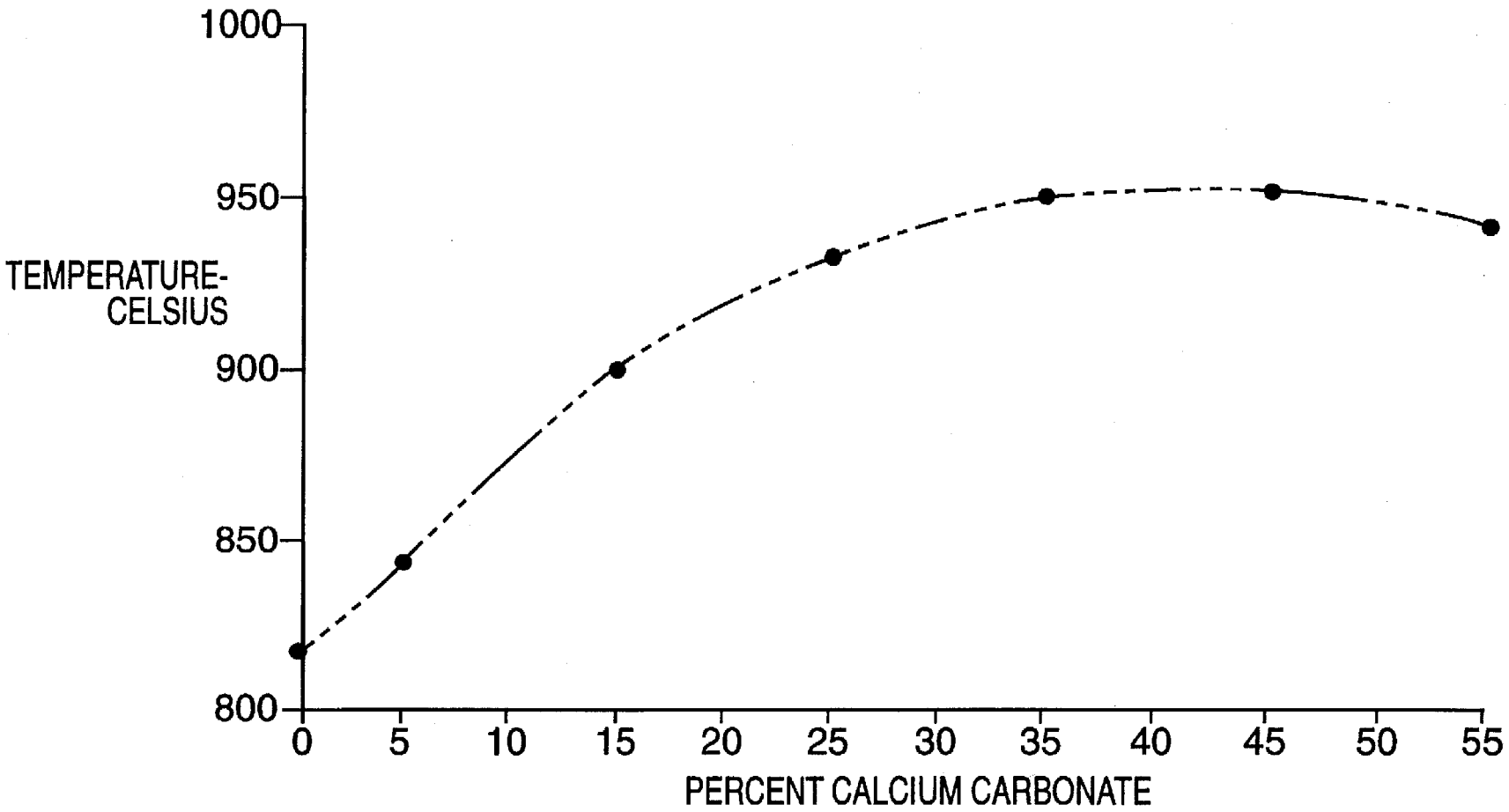
FIG. 7 is a graph showing temperature versus percent of calcium carbonate present in the hollow rod of FIG. 6.

FIG. 7 is a graph showing temperature measurements taken inside the hollow passage 36 of a cigarette made according to FIG. 6, as a function of the percentage by weight of calcium carbonate present in the formulation for the rod 32. As shown, when 5% by weight or more calcium carbonate is present, the temperature begins to increase rapidly. Preferably, the embodiment of FIG. 6 employs calcium carbonate in an amount greater than 5%, more preferably between 25% and 45% is used. As shown in FIG. 7, 45% calcium carbonate will produce the highest burn temperatures, and is the most preferred percentage for use in the thin-walled embodiment.

The higher density of the thin-walled rod 32 means that the rod 32 is less porous, and during a puff less air is drawn through the rod's lit end 50. This also means that it is more difficult for smoke generated in the annular tobacco column 34 to be drawn into the interior passage 36. For such reasons, in the embodiment according to claim 6 the thin-walled rod 32 is preferably provided with a plurality of small perforations 57, having a diameter of approximately 0.625 mm or smaller, that extend completely through the wall of the hollow rod 32. Preferably, the perforations 57 are evenly spaced and staggered, so as to effect the least reduction in wall strength of the thin-walled hollow rod 32. In an exemplary embodiment, the medium density rod 32 is provided with 64 staggered holes spaced around the cylindrical wall of the rod 32.

When the smoker draws a puff through the perforated, thin-wall embodiment, air is drawn over the lit end 50 of the rod 32, to form smoke that, as shown by arrow 52, combines with outside air 54 entering the open end of the passage 36. At the same time, the lit end 55 of the annular tobacco column 34 will generate smoke. As shown by arrow 56, some of the resulting tobacco smoke that is produced by combustion will be drawn through the perforations 57 into the hollow passage 36, where it is combined with the smoke 52 and air 54, wherein the other portion of the tobacco smoke will travel down the tobacco column 36 to the filter 14.

The combustion temperatures present as the tobacco smoke passes through the perforations in the lit end 50, which perforations are designated 57*a*, are about 940° C., which is about 240° C. higher than the combustion temperature of the center of the lit end of a conventional cigarette. As a result of the high temperature, the tobacco smoke will re-burn as it passes through the openings 57*a* into the open passage 36.

The result of the re-burn is that a more complete combustion of the smoke produced by the tobacco lit end 55 occurs, producing a drop in the level of wet particulate matter. However, even in embodiments of FIG. 6 that do not contain perforations 57, we have found a drop in the level of wet particulate matter, probably due to the fact that the high temperature of the rod's lit end 50 helps promote a more complete combustion in the lit tobacco surrounding and in contact with the rod lit end 50.

The thin-walled hollow rod 32 is preferably formed of pyrolized or non-pyrolized tobacco, carbonaceous cellulosic material, for example, tobacco dust, small particle size stems (approximately 0.18 mm), or other reclaimed tobacco, and/or pyrolized animal bone material or pyrolized wood, together with one or more binders and/or flavorants, and organic or inorganic salts.

The tobacco and carbonaceous materials are ground into small pieces and dispersed in an aqueous medium or a mixed aqueous/non-aqueous medium, together with the remaining dry ingredients (e.g., any binders, flavorants, and/or organic or inorganic salts that have been chosen). Sufficient liquid is used to obtain a paste or dough-like consistency. The mixture is then extruded, molded or cast into a hollow rod 32 of predetermined size and to have a open passage extending the full length therethrough. The rod is then dried, tobacco 34 is disposed around the rod 32, the tobacco is wrapped with cigarette paper 12, and a filter 14 is attached.

The extruded, molded, or east hollow rods 22, **22*a*, 22*b*, and 32** are dried at temperatures between 0° C. and 250° C. in any suitable manner, for example in air or a vacuum, or in an inert atmosphere, or using a microwave energy field, or any combination of these methods.

EXAMPLE 1

Flue cured tobacco stems were placed into a pyrolysis chamber with an inlet for nitrogen and an outlet valve for pyrolized by-products. A nitrogen line was attached and the pyrolysis chamber was flushed at a rate of 6 liters per minute. The nitrogen flush rate was then decreased to 0.5 liter per minute for the remainder of the pyrolysis process.

After initial flushing, the chamber was heated in 100° C. increments until a temperature of 400° C. was reached. The 400° C. temperature was maintain until no further smoke was observed from the tobacco stems, and for a period of 15 minutes thereafter. At such time, the pyrolysis chamber was cooled to room temperature, and the tobacco stems were removed. The final product was 35.43% of its initial weight.

A matrix consisting of 7.6% by weight (the percentages in the examples refer to the combined weight of the dry mixture and aqueous mixture) pyrolized tobacco stems; 30.5% of non-pyrolized tobacco; 0.15% of sodium silicate and 0.059% of guar gum as binders; 3.43% of calcium carbonate as an expanding, temperature enhancing, and ashing agent; and 0.38% of potassium citrate, 0.054% of sorbitol, and 0.027% of vanillin as flavor additives was stirred for several minutes to evenly disperse the mixture. Water (57.8% by weight) was added and the mixture stirred until a wet granular consistency was obtained. The matrix was extruded into hollow rods with an external diameter of 8.0 mm, an internal diameter of 3 mm, and a length of 100 mm utilizing a piston extruder.

The rods were dried at room temperature for 24 hours, cut to a length of 70 mm, and wrapped in cigarette paper. Thereafter, a cylindrical cellulose acetate filter plug 30 mm long and with an 8.0 mm external diameter was attached in an end-to-end relation using a filter wrap to form a cigarette.

The resulting low density hollow cigarette, having a rod density of 0.405 g/cc, was placed into a conventional smoking machine and lit. Suction was applied every minute for a two second duration to the filter end to simulate puffs. During the smoking cycle, the lit end portion formed an inverted fire cone that was contained essentially inside the longitudinal open passage of the low density rod. Between puffs, the amount of sidestream smoke observed was less than with conventional cigarettes and 1 mg of wet particulate matter was collected on a Cambridge filter pad after 9 puffs.

EXAMPLE 2

A mixture was prepared having the same ingredients as in Example 1. Prior to mixing the dry ingredients, the pyrolized tobacco stems were ground into a powder, using a ball mill, so as to have a particle size between 0.12 and 0.25 mm. Water, in an amount of 58.56% of total weight, was added, and the mixture was stirred until a dough-like consistency was reached.

The mixture was extruded into a hollow rod having an external diameter of 1.74 mm and an internal diameter of 1.65 mm and cut to a length of 70 mm. After drying, the rod had an outer diameter of 3.1 mm, an inner diameter of 1.5 mm, and a medium density (0.781 g/cc). A column of cut tobacco strands and shreds of tobacco was disposed around the outer perimeter of the cut rod and wrapped with a cigarette paper, so as to have an outer diameter of 8.0 mm. A cylindrical cellulose acetate filter plug 30 mm long and with an 8.0 mm external diameter was attached in an end-to-end relation using a filter wrap to form a cigarette of the type shown in FIG. 6. No perforations were formed in the wall of the medium density rod.

The hollow cigarette was placed into a conventional smoking machine and lit. The machine applied suction every minute for a two second duration to the filter end to simulate puffs. During the smoking cycle, the lit portion was contained essentially inside the hollow passage of the rod. Between puffs, the amount of sidestream smoke observed was less than with conventional cigarettes and 1 mg of wet particulate matter was collected on a Cambridge filter pad after 9 puffs.

Thin-walled hollow rods made in accordance with this example were also placed in the center of the tobacco column of a standard commercial full flavored cigarette, and into the center of a tobacco column of a standard commercial ultra-low tar cigarette, in each case by removing sufficient tobacco to allow for insertion, to form cigarettes as shown in FIG. 6. The cigarettes were placed in a smoking machine and tested in the same manner as above. In the case of the modified standard commercial full flavored cigarette, there was a 24.3% reduction in the amount of wet particulate matter collected, even after compensating for the reduction in tobacco. In the case of the modified standard commercial ultra-low tar cigarette, there was a 50% reduction in the amount of wet particulate matter collected.

EXAMPLE 3

A wet granular matrix was prepared as in Example 1 with the exception that 7.6% (based on total weight) of pyrolized wood was utilized in the formulation rather than the pyrolized tobacco stems. The pyrolized wood consisted of equal parts of cedar, oak, and hickory. The wood added an aromatic aroma to the smoke stream but otherwise the appearance of the cigarette and wet particulate matter delivery was the same as in Example 1. The density of the rod was 0.470 g/cc, and the lit end burned in an inverted fire cone inside the longitudinal open passage as in Example 1.

EXAMPLE 4

A wet granular matrix was prepared as in Example 1 with the exception that 7.6% of pyrolized coconut hulls, pyrolized to 30% of initial weight, was utilized in the formulation rather than pyrolized tobacco. The appearance of the low density cigarette and particulate matter delivery was the same as in Example 1. The rod had a density of 0.449 g/cc, and the lit end burned in an inverted fire cone as in Example 1.

EXAMPLE 5

A wet granular matrix was prepared from an aqueous/non-aqueous solution and a dry-mix containing the water insoluble components. The aqueous/non-aqueous solution comprised 77.73% tap water, 21.53% propylene glycol, 0.70% acacia powder, and 0.04% see-butylmalonic acid. The dry mix was composed of 80.2% non-pyrolized fine particle size (0.250–0.500 mm) flue-cured tobacco, 8.3% pyrolized tobacco, 8.0% calcium carbonate, 2.1% potassium citrate, and 1.4% guar gum.

The dry ingredients were mixed together in a Hobart mixer with a paddle blade set on medium for five minutes. A matrix consisting of 47.2% of the dry mix and 52.8% of the aqueous/non-aqueous solution were mixed in a Hobart mixer for five minutes and extruded as in Example 1 into a low density hollow rod with an external diameter of 8.0 mm and an internal diameter of 1.0 mm. The rods were cut into sections 70 mm long, dried in a microwave energy field utilizing 900 watts for a period of 4 minutes. The dried rods, which had a density of 0.411 g/cc, were wrapped in cigarette paper, and a cylindrical cellulose acetate filter plug 30 mm long and with an 8.0 mm external diameter was attached in an end-to-end relation using a filter wrap to form a cigarette.

The low density hollow cigarette was placed into a conventional smoking machine and lit. The machine applied suction every minute for a two second duration to the filter end to simulate puffs. During the smoking cycle, the lit portion was contained essentially inside the hollow passage of the rod. Between puffs, the amount of sidestream smoke observed was less than with conventional cigarettes. The smaller internal diameter of the longitudinal open passage (i.e., 1.0 mm) increased the pressure drop during puffs essentially to that of a conventional cigarette.

EXAMPLE 6

A matrix was prepared as in Example 1 with the exception that pyrolized tobacco was utilized rather than pyrolized tobacco stems. The finished cigarette delivered 1 mg of wet particulate matter after smoking as in Example 1.

EXAMPLE 7

Mixtures were prepared having the same ingredients as in Example 1, with the exception that pyrolized hardwoods were utilized as the carbon source rather than pyrolized tobacco stems, and that the level of calcium carbonate was varied in different batches. Also, prior to being added to the dry mixture, the pyrolized hardwoods were ground down into a powder, using a ball mill, having a particle size between 0.12 and 0.25 mm. Water in an amount of 58.56% was added to the dry mixture, and the resulting mixture was stirred to obtain a dough-like matrix.

The dough-like matrix was extruded into hollow rods with an external diameter of 1.74 mm and an internal diameter of 1.65 mm and cut to a length of 70 mm. Upon being dried, the rods expanded to an outer diameter of 3.1 mm and an inner diameter of 1.5 mm, and had a density of 0.781 g/cc, such that the rods were medium density rods.

The rods were embedded into the center of a column of cut tobacco and wrapped with cigarette paper, so as to have an outer diameter of 8.0 mm. Cylindrical cellulose acetate filter plugs 30 mm long and with an 8.0 mm external diameter were attached in an end-to-end relation using a filter wrap to produce cigarettes.

The hollow cigarettes were placed into a conventional smoking machine and lit. The machine applied suction every minute for a two second duration to the filter end to simulate puffs. During the smoking cycle, the lit portion was contained essentially inside the longitudinal open passage of the rod and burned with an inverted fire cone. Between puffs, the amount of sidestream smoke observed was less than with conventional cigarettes.

The static burn temperatures inside the open passage of the medium density rods was also measured during these tests, using thermocouples located at spaced locations inside the passage. FIG. 7 shows the temperature measurements for rods having different levels of calcium carbonate, up to a wet weight level of 55%. As shown, samples having a 45% calcium carbonate level produced the highest burn temperature occurred. In samples having a 45% calcium carbonate level, 1 mg of wet particulate matter was collected on a Cambridge filter pad after 9 puffs.

Thin-walled hollow rods made in accordance with this example were also placed in the center of the tobacco column of a standard commercial full flavored cigarette, and into the center of a tobacco column of a standard commercial ultra-low tar cigarette, in each case by removing sufficient tobacco to allow for insertion, to form cigarettes as shown in FIG. 6. The cigarettes were placed in a smoking machine and tested in the same manner as above. In the case of the modified standard commercial full flavored cigarette, there was a 24.3% reduction in the amount of wet particulate matter collected, even after compensating for the reduction in tobacco. In the case of the modified standard commercial ultra-low tar cigarette, there was a 50% reduction in the amount of wet particulate matter collected.

EXAMPLE 8

A mixture of calcium carbonate (5.04 g), guar gum (0.12 g), vanillin (0.12 g), sorbitol (0.12 g), dextrose (4.00 g), and water (30.0 cc) was homogenized until a smooth dispersion was attained. Thereafter, a 12.5 cc portion of 2.08% hydroxypropylcellulose solution was added and the solution mixed an additional five minutes. A 44.8 gram portion of a 50:50 blend of puffed, flue cured and burley tobacco, having a 0.300 to 0.425 mm average particle size, was placed into a 5 quart Hobart mixer bowl. An 11.2 gram portion of carbonized tobacco dust was also placed into the mixer bowl and the materials were mixed at medium speed. The aqueous mixture of thickeners and flavors was added to the tobacco in small portions over five minutes. After all of the aqueous mixture had been added, an additional 12.5 cc of 2.08% hydroxypropylcellulose solution was added and mixed an additional five minutes, to produce a wet granular matrix.

The resulting wet granular matrix was piston extruded to give undried hollow rods with an external diameter of 7.188 mm and an internal longitudinal opening with a diameter of 4.318 mm. The hollow rods were dried inside a microwave energy field at 950 watts to produce hollow rods. During the drying process, the rod expanded to an outer surface diameter of 8.00 mm and an internal diameter of 4.32 mm. A 64 mm long section of the rod weighed 1.12 g and had a density of 0.492 g/cc (i.e., was a low density rod). A filter and carbon insert disk were attached, producing a cigarette of the type shown in FIG. 5.

The cigarette was placed in a conventional smoking machine and lit. Suction was applied every minute for a two second duration to the filter end to simulate puffs. During the smoking cycle, the lit portion formed an inverted fire cone that was contained essentially inside the longitudinal open passage of the rod. Between puffs, the amount of sidestream smoke observed was less than with conventional cigarettes and 2.9 mg of wet particulate matter was collected on a Cambridge filter pad after 12 puffs.

EXAMPLE 9

A matrix was prepared as in Example 8, with the exception that no pyrolized tobacco was used, the flavors and gum were dispersed in 15 cc of water rather than 30 cc, and 56.0 g of a 50:50 blend of puffed flue cured and burley tobacco (0.300 to 0.425 mm average particle size) was used to prepare the wet granular matrix. The dried rod had an external diameter of 8.48 mm, an interior diameter of 4.32 mm, and a 64 mm section weighed 0.9359 g, meaning that the rod had a density of 0.349 g/cc.

The external diameter was reduced to 8.0 mm and prepared into a cigarette as in Example 8. When smoked as in Example 8, it delivered 4.8 mg of wet particulate matter after 10 puffs. Also, the amount of sidestream smoke was less than with conventional cigarettes.

EXAMPLE 10

A matrix was prepared as in Example 8, with the exception that the flavors and guar gum were dispersed in 15 cc of water rather than 30 cc. The finished cigarette had an external diameter of 8.51 mm, an internal diameter of 4.32 mm, and a 64 mm section weighed 1.0817 g, thereby having a density of 0.401 g/cc.

The external diameter was reduced to 8.0 mm and prepared into a cigarette as in Example 8. When smoked as in Example 8, it delivered 4.6 mg of wet particulate matter after 10 puffs. Also, the amount of sidestream smoke was less than with conventional cigarettes.

EXAMPLE 11

A wet granular matrix was prepared as in Example 9, with the exception that a puffed 50:50 flue cured/burley blend with an average particle size of 0.425 mm and 30 cc of water was used to mix the flavors and guar gum. The dried low density hollow rods (0.466 g/cc) had an external diameter of 8.69 mm, an internal diameter of 4.32 mm, and a 64 mm section weighed 1.33 g.

The external diameter was reduced to 8.0 mm and prepared into a cigarette as in Example 8. When smoked as in Example 8, it delivered 0.5 mg of wet particulate matter after 10 puffs. Also, the amount of sidestream smoke was less than with conventional cigarettes.

EXAMPLE 12

A wet granular matrix was prepared as in Example 11, with the exception that the avenge particle size of the puffed tobacco was between 0.375 and 0.425 mm. The dried low density hollow rods (0.488 g/cc) had an external diameter of 8.1 mm, an internal diameter of 4.32 mm, and a 64 mm section weighed 1.15 g.

The external diameter was reduced to 8.0 mm and prepared into a cigarette as in Example 8. When smoked as in Example 8, it delivered 1.5 mg of wet particulate matter after 12 puffs. Also, the amount of sidestream smoke was less than with conventional cigarettes.

EXAMPLE 13

A wet granular matrix was prepared by first pre-mixing the following two aqueous mixes and a dry mix.

| | Weight |
|---|---|
| Aqueous Mix 1 | |
| water | 11.80 g |
| propylene glycol | 2.40 g |
| glyceric | 0.83 g |
| calf gelatin | 0.30 g |
| hydroxypropylcellulose | 0.50 g |
| guar gum | 0.03 g |
| sodium carboxymethyl-cellulose | 0.15 g |
| brown sugar | 2.40 g |
| maltol | 0.03 g |
| yeast | 0.20 g |
| Aqueous Mix 2 | |
| water | 0.50 g |
| potassium citrate | 0.75 g |
| Dry Mix | |
| 50:50 blend of puffed, flue cured and burley (0.250–0.500 mm size) | 24.00 g |
| carbonized tobacco dust | 2.50 g |
| calcium carbonate | 2.50 g |
| manganese dioxide (5μ size) | 1.75 |
| zinc metal (25μ size) | 0.25 g |

The dry mix was mixed at slow speed for 5 minutes utilizing a 5 quart Hobart mixer. Next, Aqueous Mix 1, which had been pre-mixed at 60° C. to activate the yeast, was added over five minutes. Aqueous Mix 2 was added drop-by-drop and the matrix was allowed to mix for an additional five minutes, producing a wet granular matrix. The matrix was piston extruded to give undried hollow rods with an external diameter of 6.00 mm and an internal longitudinal opening with a diameter of 3.90 mm. The hollow rods were dried inside a microwave energy field at 950 watts to produce low density hollow rods. During drying, the rods expanded to an external diameter of 8.00 mm and a longitudinal internal diameter of 4.00 mm. A 64 mm section of the dried hollow rod weighed 1.06 g, such that the density was 0.439 g/cc. A cellulose acetate filter plug and carbon insert disk were then attached, in an end-to-end relation, to produce a cigarette.

The low density cigarette was placed in a conventional smoking machine and lit. Suction was applied every minute for a two second duration to the filter end to simulate puffs. During the smoking cycle, the lit portion formed an inverted fire cone that was contained essentially inside the longitudinal open passage of the rod. Between puffs, the amount of sidestream smoke observed was less than with conventional cigarettes and 4.0 mg of wet particulate matter was collected on a Cambridge filter pad after 12 puffs.

EXAMPLE 14

A wet granular matrix was prepared as in Example 13, but without manganese dioxide or zinc. Low density rods were used to form and evaluate cigarettes as in Example 13. 3.6 mg of wet particulate matter was obtained during 12 puffs. Also, the amount of sidestream smoke was less than with conventional cigarettes.

EXAMPLE 15

A wet granular matrix was prepared from the following two Aqueous Mixes, and one Dry Mix, in the same manner as in Example 13:

| | Weight |
|---|---|
| Aqueous Mix 1 | |
| water | 17.63 g |
| glycol | 9.11 g |
| calf gelatin | 1.42 g |
| carboxymethylcellulose | 0.30 g |
| white sugar | 0.49 g |
| maltol | 0.03 g |
| yeast | 0.03 g |
| Aqueous Mix 2 | |
| water | 6.50 g |
| urea | 0.75 g |
| potassium citrate | 0.75 g |
| Dry Mix | |
| 50:50 blend of puffed flue cured and burley (0.250-0.600 mm size) | 72.00 g |
| calcium carbonate | 7.50 g |

The resulting wet granular matrix was piston extruded to produce undried hollow rods with an external diameter of 4.70 mm and internal longitudinal opening with a diameter of 1.50 mm. The hollow rods were dried inside a microwave energy field at 950 watts to produce low density hollow rods. During the drying process, the rods expanded to an external diameter of 8.0 mm and a longitudinal internal diameter of 1.20 mm. A 64 mm section of the dried low density hollow rod weighed 0.88 g, thus having a density of 0.279 g/cc. The rods were used to form cigarettes which were prepared and evaluated as in Example 13. 5.2 mg of wet particulate matter was obtained over 12 puffs.

EXAMPLE 16

A wet granular matrix was prepared and evaluated as in Example 15, but with the following amounts of Aqueous Mix 1:

| Aqueous Mix 1 | Weight |
|---|---|
| water | 20.48 g |
| glycol | 10.59 g |
| calf gelatin | 1.65 g |
| carboxymethylcellulose | 0.35 g |
| white sugar | 0.57 g |
| yeast | 0.35 g |
| guar gum | 0.30 g |

The rod expanded from 4.70 mm to a final external diameter of 8.0 mm and an inner diameter of 1.2 mm during the drying process, and a 64 mm section weighed 0.95 g. Thus the rod had a density of 0.302 g/cc. Cigarettes were prepared as in Example 15, and 2.9 mg of wet particulate matter was obtained during 9 puffs.

EXAMPLE 17

A large scale wet granular mixture was prepared utilizing an Aqueous Mix 1, an Aqueous Mix 2, an Aqueous Mix 3, and a Dry Mix as set out below.

| | Weight |
|---|---|
| Aqueous Mix 1 | |
| water | 117.00 g |
| glycol | 72.70 g |
| Histar-TPF (humectant) | 14.10 g |
| calf gelatin | 15.15 g |
| hydroxypropylcellulose | 4.40 g |
| guar gum | 2.00 g |
| Aqueous Mix 2 | |
| water | 15.70 g |
| potassium citrate | 15.50 g |
| Aqueous Mix 3 | |
| water | 145.70 g |
| brown sugar | 55.80 g |
| white sugar | 34.10 g |
| honey | 55.80 g |
| Histar-TPF (humectant) | 5.00 g |
| yeast | 9.30 g |
| glycol | 13.60 g |
| Dry Mix | |
| flue cured puffed tobacco (0.250–0.600 mm particle size) | 744.00 g |
| calcium carbonate | 77.40 g |
| pyrolized tobacco dust | 77.00 g |

The Dry Mix was mixed at slow speed for 5 minutes utilizing a 50 quart Hobart mixer. Next, Aqueous Mix 1, which had been pre-mixed, was added to the Dry Mix over a period of five minutes. Aqueous Mix 2 was next added, drop-by-drop, over a period of 5 minutes. Finally, Aqueous Mix 3, pre-mixed at 60° C. to activate the yeast, was added over a period of ten minutes and the matrix was allowed to mix for an additional 15 minutes, forming a wet granular matrix.

A Plymouth Locomotive PX-3, Model CH-TJ, single screw auger extrusion machine with a 1 HP motor drive, having a variable speed between 10 RPM and 30 RPM, was utilized to extrude the wet granular matrix into hollow rods. The rods had an external diameter of 5.30 mm and an internal longitudinal opening with a diameter 1.50 mm. The hollow rods were dried inside a microwave energy field at 950 watts to form low density hollow rods. When dried, the rods expanded to an external diameter of 8.0 mm and a longitudinal internal diameter of 1.20 mm. A 64 mm section of the dried low density hollow rod weighed 1.15 g, and thus the rod had a density of 0.366 g/cc.

Thereafter, a cylindrical cellulose acetate plug 30 mm long and with an 8.0 mm external diameter and a carbon insert disk were attached in an end-to-end relation using a filter wrap to form a cigarette.

The low density cigarette was placed in a conventional smoking machine and lit. Suction was applied every minute for a two second duration to the filter end to simulate puffs. During the smoking cycle, the lit portion formed an inverted fire cone that was contained essentially inside the longitudinal open passage of the rod. Between puffs, the amount of sidestream smoke observed was less than with conventional cigarettes and 4.1 mg of wet particulate matter was collected on a Cambridge filter pad after 13 puffs.

EXAMPLE 18

A wet granular matrix was prepared according to the method of Example 17, but using the following mixes.

| | Weight |
|---|---|
| Aqueous Mix 1 | |
| water | 618.10 g |
| glycerin | 87.10 g |
| glycol | 87.10 g |
| calf gelatin | 15.90 g |
| hydroxypropylcellulose | 2.50 g |
| guar gum | 2.90 g |
| Aqueous Mix 2 | |
| water | 29.40 g |
| potassium citrate | 29.40 g |
| Aqueous Mix 3 | |
| water | 70.70 g |
| brown sugar | 21.20 g |
| honey | 21.20 g |
| white sugar | 14.10 g |
| glycerin | 14.10 g |
| Dry Mix | |
| flue cured puffed tobacco (0.250–0.600 mm particle size) | 141.30 g |
| 50:50 blend of puffed flue-cured and burley tobacco stems (0.180 mm average size | 1,271.00 g |
| calcium carbonate | 47.10 g |
| pyrolized tobacco dust | 58.90 g |

The PX-3 single screw extruder was equipped with a die to extrude undried hollow rods with an external diameter of 8.0 mm and an internal diameter of 1.5 mm. The rods were dried as in Example 18, and the rods expanded to an external diameter of 13.0 mm.

The PX-3 was re-equipped with a die to extrude undried hollow rods with an external diameter of 5.30 mm and an internal diameter of 1.5 mm. The rods were dried as in Example 18, and the rods expanded to an external diameter of 8.0 mm and an internal passage diameter of 1.5 mm. The exterior cylindrical surface of the rods was smooth, and a 64 mm section weighed 1.13 g, meaning that the rod had a density of 0.364 g/cc. Cigarettes were prepared including a filter and carbon insert disk and tested on a smoking machine as described before. The cigarette delivered 3.6 mg of wet particulate matter during 12 puffs.

EXAMPLE 19

A wet granular mixture was prepared utilizing an Aqueous Mix 1, an Aqueous Slurry 1, and a Dry Mix as set out below.

| | Weight |
|---|---|
| Aqueous Mix 1 | |
| water | 490.00 g |
| hydroxypropylcellulose | 10.19 g |
| Aqueous Slurry 1 | |
| water | 300.00 g |
| calcium carbonate | 100.80 g |
| guar gum | 2.40 g |
| vanillin | 2.40 g |
| sorbitol | 2.40 g |
| dextrose | 40.00 g |
| Dry Mix | |
| a 50:50 blend of puffed flue cured and burley (0.300–0.425 mm particle size) | 896.00 g |
| pyrolized tobacco dust | 224.00 g |

The dry mix was placed into a 50 quart Hobart mixer and blended at medium speed for 5 minutes. Half of the Aqueous Mix 1 was then added to the Aqueous Slurry 1 and blended for an additional 5 minutes. This mixture was added to the Dry Mix over a period of 5 minutes, and the matrix was blended an additional five minutes thereafter. Finally, the remainder of Aqueous Mix 1 was added, and the total mixture was blended at medium speed for 30 minutes, forming a wet granular matrix. The matrix was extruded using the PX-3 extruder as in Example 18 to form undried hollow rods with an external diameter of 7.21 mm and an internal diameter of 5.08 mm.

The rods were dried in a microwave energy field at 950 watts, and the rods expanded to an external diameter of 8.00 mm and an internal diameter of 5 mm. A 64 mm section of the dried rod weighed 1.15 g, such that the rod had a density of 0.587 g/cc.

Thereafter, a cylindrical cellulose acetate plug 30 mm long and with an 8.0 mm external diameter and a carbon insert disk were attached in an end-to-end relation using a filter wrap to form a cigarette.

The low density cigarette was placed in a conventional smoking machine and lit. Suction was applied every minute for a two second duration to the filter end to simulate puffs. During the smoking cycle, the lit portion formed an inverted fire cone that was contained essentially inside the longitudinal open passage of the rod. Between puffs, the amount of sidestream smoke observed was less than with conventional cigarettes and 6.6 mg of wet particulate matter was collected on a Cambridge filter pad after 12 puffs.

EXAMPLE 20

A dough-like matrix, composed of 14 grams of milled carbonized material (hardwoods), 0.35 gram of methylcellulose, 0.061 gram of guar gum, 4.9 grams of calcium carbonate, and 14.0 grams of water, was prepared in the manner described in Example 7. The matrix was extruded to form thin-walled rods, which were dried and cut to a length of 64 mm. The dried rods had an outside diameter of 2.794 mm, an inside diameter of 2.082 mm, and a density of 0.861 g/cc (i.e., were medium density rods). Sixty four holes, each approximately 0.625 mm wide, were then formed through the wall of the rod. The holes were evenly distributed and staggered about the outside cylindrical surface of the rod.

A sample thin-walled rod was placed in the center of the tobacco column of a standard commercial full flavored cigarette, and another sample was inserted into a standard commercial ultra-low tar cigarette, in each case by removing sufficient tobacco to allow for insertion, to form cigarettes as shown in FIG. 6. The cigarettes were placed in a smoking machine and tested in the same manner as the other examples. In the case of the modified standard commercial full flavored cigarette, there was a 57.4% reduction in the amount of wet particulate matter collected, even after compensating for the reduction in tobacco. In the case of the modified standard commercial ultra-low tar cigarette, there was a 93% reduction in the amount of wet particulate matter collected.

The foregoing represents preferred embodiments of the invention. Variations and modifications will be apparent to persons skilled in the art, without departing from the inventive principles disclosed herein. All such modifications and variations are intended to be within the scope of the invention, as defined in the following claims.

We claim:

1. A hollow cigarette comprising a combustible rod comprised of tobacco particles and a binder, said rod having opposite ends, wherein one of said opposite ends is intended to be lit, wherein said rod has an annular wall defining a hollow passage extending therethrough to allow air to enter said one end and air and smoke pass freely through said hollow passage and out the opposite end, wherein said rod has an external diameter in the range of 5–10 mm, wherein said hollow passage has a diameter in the range of 0.5–6.5 mm, and wherein said rod has a density less than 0.6 g/cc such that the lit end burns in the shape of an inverted, concave fire cone, thereby creating a high temperature at the entrance to said hollow passage, such that incomplete combustion products are re-burned as they enter the hollow passage, thereby enhancing the combustion process.

2. A cigarette according to claim 1, wherein said rod has a density in the range of 0.2–0.6 g/cc.

3. A cigarette according to claim 2, wherein the rod is formed from a matrix comprising puffed tobacco or puffed tobacco stems.

4. A cigarette according to claim 3, further comprising a wrapping paper disposed about and contacting said rod and forming an outer surface of said cigarette.

5. A cigarette according to claim 2, wherein said rod includes yeast.

6. A cigarette according to claim 1, further comprising a filter secured to said opposite end.

7. A cigarette according to claim 6, further comprising a carbon insert disk, having a hole therethrough, between said filter and rod.

8. A cigarette according to claim 1, wherein said rod includes a pyrolized tobacco material.

9. A cigarette according to claim 1, wherein said rod is formed from at least one additional carbonaceous material.

10. A hollow cigarette comprising a thin-walled combustible rod, a wrapping paper disposed about said rod, and a column of tobacco disposed between said rod and said wrapping paper, wherein said thin-walled rod is formed from at least one carbonaceous material, a binder, and an organic or inorganic salt, said rod having opposite ends, wherein one of said opposite ends, along with the surrounding column of tobacco, is intended to be lit, wherein said rod has a hollow passage extending therethrough to allow air to enter said one end and air and smoke pass freely through said hollow passage and out the opposite end, wherein said rod has an external diameter in the range of 1.0–5.0 mm, wherein said passage has a diameter in the range of 0.5–3.0 mm, and wherein said rod has a density less than 1.0 g/cc such that the lit end of said rod and surrounding tobacco column burns in the shape of an inverted, concave fire cone.

11. A cigarette according to claim 10, wherein said rod has a density in the range of 0.6–1.0 g/cc, and wherein said rod contains a plurality of perforations spaced along its length such that at least a portion of the smoke generated by said column of tobacco is drawn through perforations that are at a higher temperature than the burning tobacco, such that said smoke, which contains incomplete combustion products, is re-burned as it passes into said hollow passage and towards said opposite end.

12. A cigarette according to claim 11, further comprising a filter secured to said opposite end.

13. A cigarette according to claim 12, wherein said at least one carbonaceous material comprises tobacco particles.

14. A cigarette according to claim 11, wherein said rod includes a salt in an amount greater than 5%.

15. A cigarette according to claim 14, wherein said salt is calcium carbonate.

16. A cigarette according to claim 15, wherein said rod includes calcium carbonate in an amount between 25% and 45%.

17. A cigarette according to claim 16, wherein said rod includes calcium carbonate in an amount of approximately 45%.

* * * * *